US006141967A

United States Patent [19]

Angel et al.

[11] Patent Number: 6,141,967

[45] Date of Patent: Nov. 7, 2000

[54] AIR FUEL MIXER FOR GAS TURBINE COMBUSTOR

[75] Inventors: Paul R. Angel, Fairfield, Ohio; James M. Caldwell, Alexandria, Ky.; Narendra D. Joshi, Cincinnati, Ohio; Steven Marakovits, Mason, Ohio; Kelley A. Foresman, Cincinnati, Ohio; Steven G. Goebel, Clifton Park; Richard E. Warren, Jr., Schenectady, both of N.Y.

[73] Assignee: General Electric Company, Cincinnati, Ohio

[21] Appl. No.: 09/005,343

[22] Filed: Jan. 9, 1998

[51] Int. Cl.[7] ..... F02C 1/00; F23R 3/14

[52] U.S. Cl. ..... 60/737; 60/748; 239/405; 239/406

[58] Field of Search ..... 60/737, 748, 740, 60/742; 239/400, 403, 405, 406, 424.5

[56] References Cited

U.S. PATENT DOCUMENTS

| | | | |
|---|---|---|---|
| 2,146,250 | 2/1939 | D'Elia | 239/405 |
| 2,526,220 | 10/1950 | Goddard | 239/406 |
| 3,788,067 | 1/1974 | Carlisle et al. | 60/742 |
| 4,365,753 | 12/1982 | Harding et al. | 239/404 |
| 4,854,127 | 8/1989 | Vinson et al. | 60/742 |
| 5,165,241 | 11/1992 | Joshi et al. | 60/737 |
| 5,251,447 | 10/1993 | Joshi et al. | 60/737 |
| 5,351,477 | 10/1994 | Joshi et al. | 60/737 |
| 5,590,529 | 1/1997 | Joshi et al. | 60/737 |
| 5,638,682 | 6/1997 | Joshi et al. | 60/737 |
| 5,675,971 | 10/1997 | Angel et al. | 60/737 |
| 5,680,766 | 10/1997 | Joshi et al. | 60/737 |
| 5,827,054 | 10/1998 | Sarv et al. | 239/405 |

*Primary Examiner*—Ted Kim

*Attorney, Agent, or Firm*—Andrew C. Hess; William Scott Andes

[57] ABSTRACT

An apparatus for premixing fuel and air prior to combustion in a gas turbine engine, including: a linear mixing duct having a circular cross-section defined by a wall; a centerbody located along a central axis of the mixing duct and extending substantially the full length of the mixing duct, the centerbody having a plurality of orifices therein to inject fuel into the mixing duct with an axial velocity component; a fuel supply in flow communication with the centerbody orifices; an outer annular swirler located adjacent an upstream end of the mixing duct and including a plurality of circumferentially spaced vanes oriented so as to swirl air flowing therethrough in a first direction; an inner annular swirler located adjacent the mixing duct upstream end and including a plurality of circumferentially spaced vanes, the vanes having an outer radial portion having a leading edge and a trailing edge oriented so as to swirl air flowing therethrough in a second direction opposite the first swirl direction by the outer annular swirler vanes and an inner radial portion with a leading edge and a trailing edge oriented so as to provide a boundary layer of air substantially along the centerbody; and, a hub separating the inner and outer annular swirlers to permit independent rotation of an air stream therethrough. The outer annular swirler may also include vanes having an inner radial portion with a leading edge and a trailing edge oriented so as to swirl the air flow therethrough and an outer radial portion having a leading edge and a trailing edge oriented so as to provide a boundary layer of air substantially along the mixing duct wall. High pressure air is injected from a compressor into the mixing duct through the inner and outer annular swirlers and fuel is injected into the mixing duct so that the high pressure air and the fuel is uniformly mixed therein, whereby minimal formation of pollutants is produced when the fuel/air mixture is exhausted out the downstream end of the mixing duct into a combustor and ignited.

39 Claims, 11 Drawing Sheets

AIR FUEL MIXER FOR GAS TURBINE COMBUSTOR

BACKGROUND OF THE INVENTION

1. Field of the Invention

The present invention relates generally to an air fuel mixer for the combustor of a gas turbine engine and, in particular, to an air fuel mixer which uniformly mixes fuel and air so as to reduce NOx formed by the ignition of the fuel/air mixture and minimizes auto-ignition and flashback therein.

2. Description of Related Art

The present invention involves an air/fuel mixer for a gas turbine combustor which provides gaseous and/or liquid fuel to the mixing duct so as to be mixed with air to form a uniform air/fuel mixture. Other dual fuel mixers in the art include U.S. Pat. No. 5,351,477 to Joshi et al. and Ser. No. 08/304,341 now U.S. Pat. No. 5,511,375 to Joshi et al., both of which are owned by the assignee of the present invention. Each of these prior art air/fuel mixers, as well as the mixer of the present invention, includes a mixing duct, a set of inner and outer counter-rotating swirlers adjacent to the upstream end of the mixing duct, and a hub separating the inner and outer swirlers to allow independent rotation of the air flow therethrough.

It has been found, however, that these dual fuel mixer designs do not include features to adequately reduce fuel residence time in the mixing duct or otherwise prevent auto-ignition or flashback. Accordingly, a patent application entitled "Dual Fuel Mixer For Gas Turbine Combustor," having Ser. No. 08/581,817, now U.S. Pat. No. 5,680,766 was filed by the assignee of the present invention to address the problems of auto-ignition and flashback. The '817 patent application includes features which energize the boundary layer flow along the mixing duct wall and the centerbody. Nevertheless, it has been found at high pressure and temperature conditions, typical of aircraft engine operation, that liquid fuel can still be entrained into separate regions and remain there long enough to auto-ignite. This can occur through flow separation from the swirler vanes, as well as by flow separation which occurs downstream of the circular fuel jets and air-assist openings disclosed in the '817 application.

Another patent application entitled "Dual Fuel Mixer For Gas Turbine Combustor," having Ser. No. 08/581,818, was further filed by the assignee of the present invention. The mixer design of the '818 application includes features for improving liquid fuel atomization by impinging fuel jets. Once again, at high pressure and temperature conditions, the bulk residence time in the mixing duct has been found to be long enough in some instances to permit liquid fuel to mix with the air flow and auto-ignite. Thus, while improved liquid fuel atomization is desirable, fuel residence time in the mixing duct must be reduced to prevent auto-ignition and/or flashback from occurring at high power operating conditions.

In light of the foregoing, it would be desirable for an air fuel mixer to be developed which better addresses the problems of auto-ignition and flashback while maintaining an emphasis on uniformly mixing liquid and/or gaseous fuel with air so as to reduce NOx formed by the ignition of the air/fuel mixture.

SUMMARY OF THE INVENTION

In accordance with a first aspect of the present invention, an apparatus for premixing fuel and air prior to combustion in a gas turbine engine is disclosed as including: a linear mixing duct having a circular cross-section defined by a wall; a centerbody located along a central axis of the mixing duct and extending substantially the full length of the mixing duct, the centerbody having a plurality of orifices therein to inject fuel into the mixing duct; a fuel supply in flow communication with the centerbody orifices; an outer annular swirler located adjacent an upstream end of the mixing duct and including a plurality of circumferentially spaced vanes oriented so as to swirl air flowing therethrough in a first direction; an inner annular swirler located adjacent the mixing duct upstream end and including a plurality of circumferentially spaced vanes, the vanes having an outer radial portion with a leading edge and a trailing edge oriented so as to swirl air flowing therethrough in a second direction opposite the first swirl direction by the outer annular swirler vanes and an inner radial portion with a leading edge and a trailing edge oriented so as to provide a boundary layer of air substantially along the centerbody; and, a hub separating the inner and outer annular swirlers to permit independent rotation of an air stream therethrough. High pressure air is injected from a compressor into the mixing duct through the inner and outer annular swirlers and fuel is injected into the mixing duct so that the high pressure air and the fuel is uniformly mixed therein, whereby minimal formation of pollutants is produced when the fuel/air mixture is exhausted out the downstream end of the mixing duct into a combustor and ignited.

In accordance with a second aspect of the present invention, an apparatus for premixing fuel and air prior to combustion in a gas turbine engine is disclosed as including: a linear mixing duct having a circular cross-section defined by a wall; a fuel supply in flow communication with said mixing duct; an inner annular swirler located adjacent an upstream end of the mixing duct and including a plurality of circumferentially spaced vanes oriented so as to swirl air flowing therethrough in a first direction; an outer annular swirler located adjacent the mixing duct upstream end and including a plurality of circumferentially spaced vanes, the vanes having an outer radial portion with a leading edge and a trailing edge oriented so as to provide a boundary layer of air substantially along the mixing duct wall and an inner radial portion having a leading edge and a trailing edge oriented so as to swirl air flowing therethrough in a second direction opposite the first swirl direction by the inner annular swirler vanes; and, a hub separating the inner and outer annular swirlers to permit independent rotation of an air stream therethrough. High pressure air from a compressor is injected into the mixing duct through the inner and outer annular swirlers and fuel is injected into the mixing duct so that the high pressure air and the fuel is uniformly mixed therein, whereby minimal formation of pollutants is produced when the fuel/air mixture is exhausted out the downstream end of the mixing duct into a combustor and ignited.

In accordance with a third aspect of the present invention, an apparatus for premixing fuel and air prior to combustion in a gas turbine engine is disclosed as including: a linear mixing duct having a circular cross-section defined by a wall; a set of inner and outer annular counterrotating swirlers adjacent an upstream end of the mixing duct; a hub separating the inner and outer annular swirlers to allow independent rotation of an air stream through the swirlers; a centerbody located along a central axis of the mixing duct and extending substantially the full length of the mixing duct, the centerbody having a plurality of orifices therein located downstream of the inner and outer annular swirlers to inject fuel into the mixing duct, each of the orifices being oriented so as to provide an axial velocity component to the injection of the fuel; and, a fuel supply in flow communication with the orifices. High pressure air is injected from a compressor into the mixing duct through the inner and outer annular swirlers and fuel is uniformly mixed therein, whereby minimal formation of pollutants is produced when the fuel/air mixture is exhausted out the downstream end of the mixing duct into a combustor and ignited.

In accordance with a fourth aspect of the present invention, an apparatus for premixing fuel and air prior to combustion in a gas turbine engine is disclosed as including: a linear mixing duct having a circular cross-section defined by a wall; a set of inner and outer annular counter-rotating swiriers adjacent an upstream end of the mixing duct; a hub separating the inner and outer annular swirlers to allow independent rotation of an air stream through the swirlers; a centerbody located along a central axis of the mixing duct and extending substantially the full length of the mixing duct, the centerbody including a plurality of fuel posts therein located downstream of the inner and outer annular swirlers to inject fuel into the mixing duct, an air cavity in flow communication with an air supply, and an aerodynamically-shaped air slot located concentrically about each said fuel post in flow communication with said air cavity, wherein air flows through said aerodynamically-shaped slots to assist atomization and break up of fuel injected into said mixing duct through said posts while minimizing any flow separated region forming along said centerbody; and, a fuel supply in flow communication with the orifices. High pressure air is injected from a compressor into the mixing duct through the inner and outer annular swirlers and fuel is uniformly mixed therein, whereby minimal formation of pollutants is produced when the fuel/air mixture is exhausted out the downstream end of the mixing duct into a combustor and ignited.

BRIEF DESCRIPTION OF THE DRAWINGS

While the specification concludes with claims particularly pointing out and distinctly claiming the present invention, it is believed the same will be better understood from the following description taken in conjunction with the accompanying drawings in which:

DETAILED DESCRIPTION OF THE INVENTION

Figure 1:
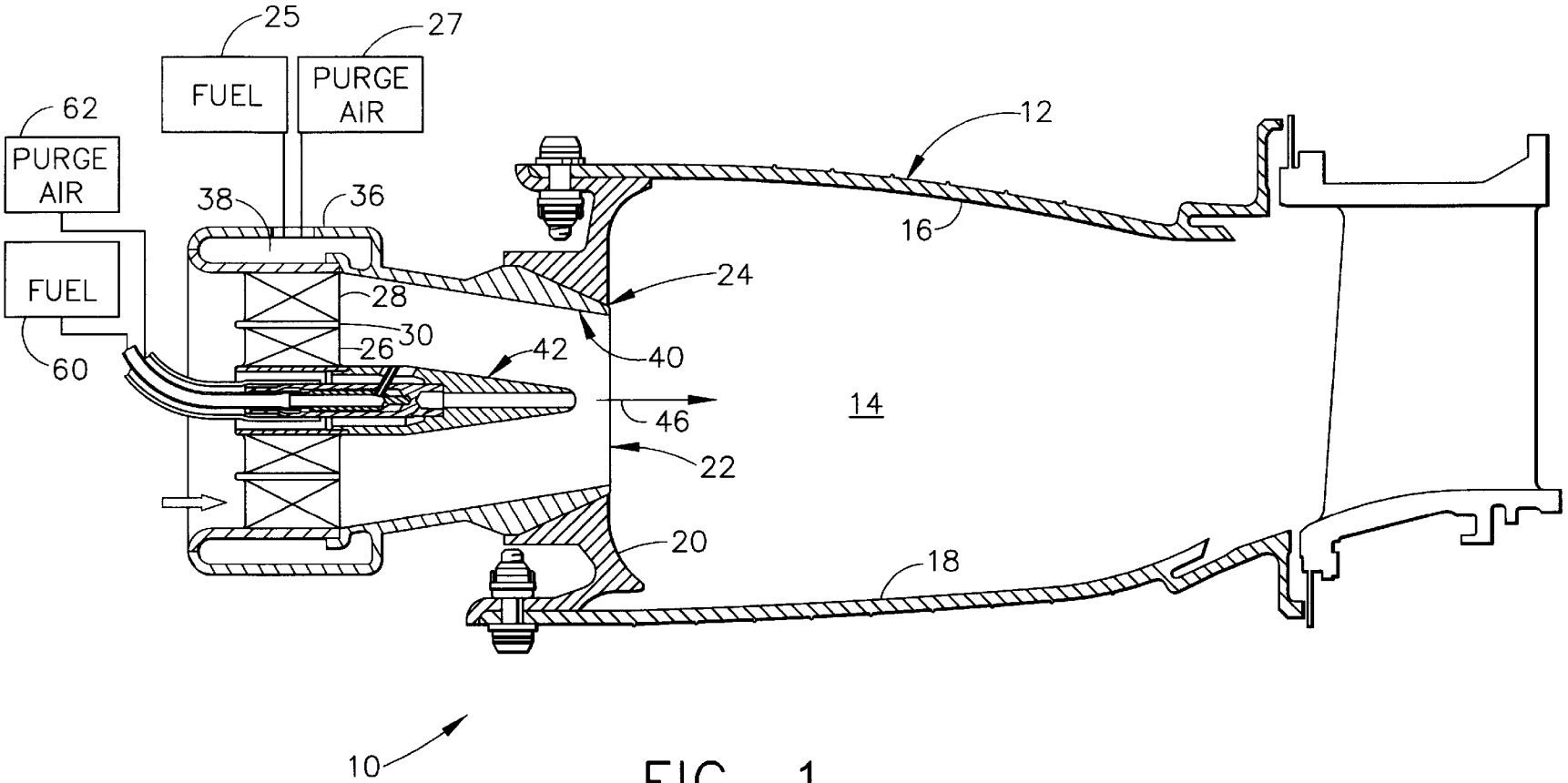
FIG. 1 is a partial cross-sectional view through a single annular combustor structure including an air/fuel mixer in accordance with the present invention.

Referring now to the drawings in detail, wherein identical numerals indicate the same elements throughout the figures, FIG. 1 depicts a partial cross-sectional view of a continuous burning combustion apparatus 10 of the type suitable for use in a gas turbine engine and comprises a hollow body 12 which defines a combustion chamber 14 therein. Hollow body 12 is generally annular in form and is comprised of an outer liner 16, an inner liner 18, and a domed end or dome 20. The domed end 20 of hollow body 12 includes a swirl cup 22, having disposed therein a mixer 24 to promote the uniform mixing of fuel and air therein and the subsequent introduction of the fuel/air mixture into combustion chamber 14 with the minimal formation of pollutants caused by the ignition thereof.

Figure 3:
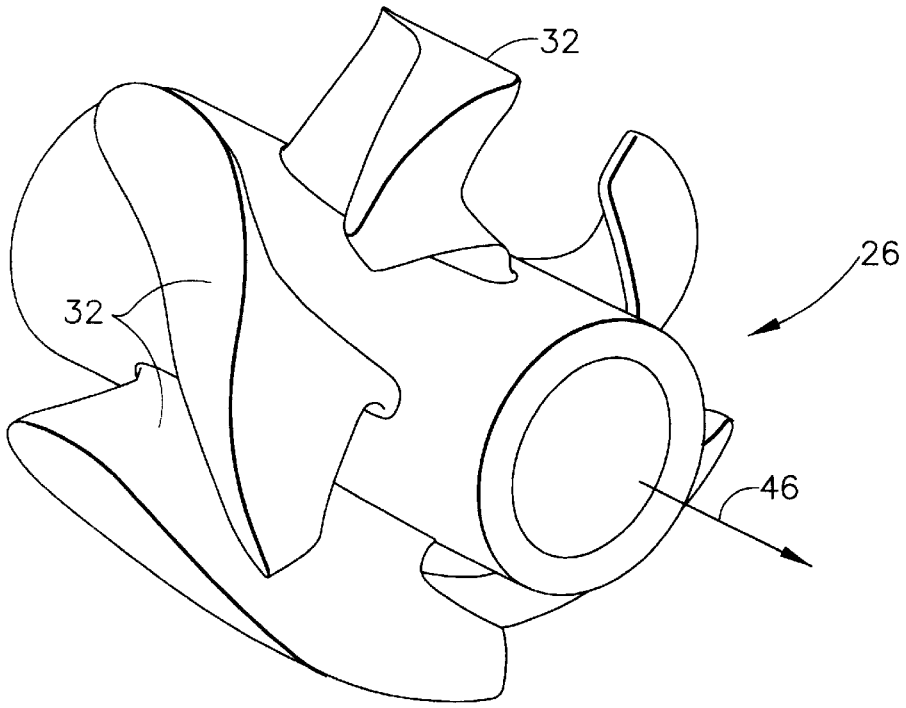
FIG. 3 is an aft perspective view of the inner annular swirler for the air/fuel mixer depicted in FIGS. 1 and 2.
Figure 4:
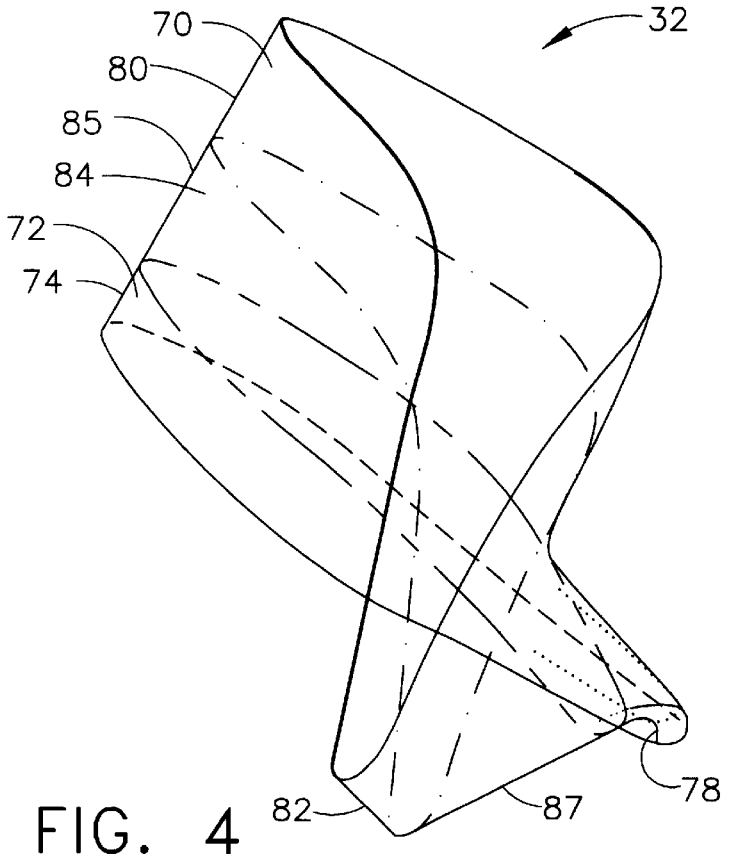
FIG. 4 is a perspective view of an inner annular swirler vane depicted in FIG. 3, wherein a plurality of separate cross-sections at different radial heights is shown.
Figure 6:
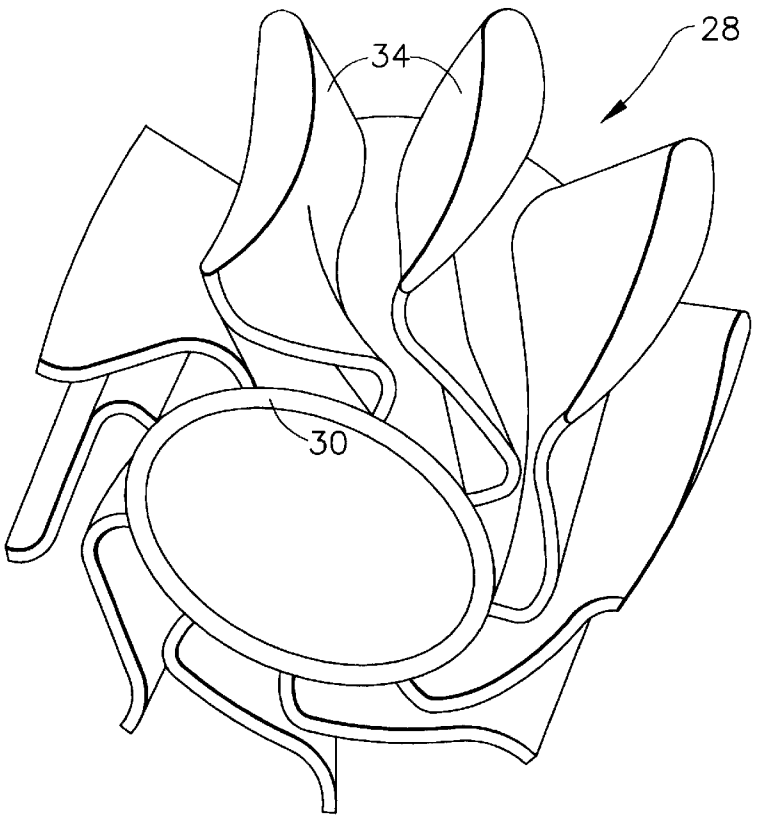
FIG. 6 is an aft perspective view of the outer annular swirler for the air/fuel mixer depicted in FIGS. 1 and 2.
Figure 9:
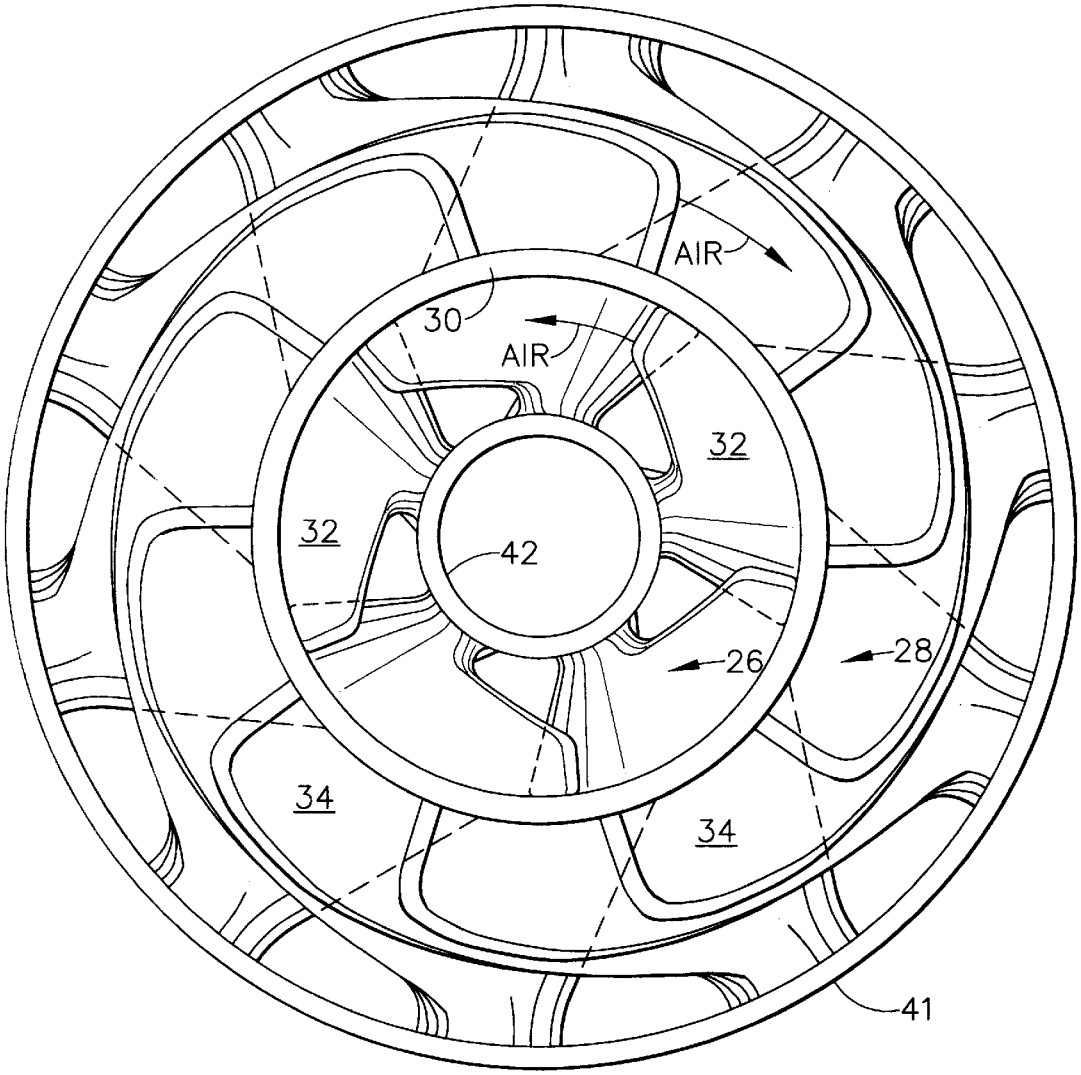
FIG. 9 is an aft view of the inner and outer annular swirlers depicted in FIGS. 1–3 and 6.

It will be seen that air fuel mixer 24 includes an inner annular swirler 26 and an outer annular swirler 28 which are brazed or otherwise set in swirl cup 22. Inner and outer annular swirlers 26 and 28 are configured with vanes 32 and 34, respectively, so as to promote counter-rotation to an air flow provided thereto (see FIGS. 3, 6 and 9). A hub 30 is utilized to separate inner and outer annular swirlers 26 and 28, which allows them to be co-annular and still separately rotate air entering the upstream ends thereof.

As appreciated by a review of FIGS. 3–5C, inner annular swirler vanes 32 preferably have been modified from previous designs to include an outer radial portion 70 (i.e., toward the blade tip) which provides swirl to an air stream flowing therethrough in a direction opposite the swirl provided by outer annular swirler vanes 34, as well as an inner radial portion 72 (i.e., toward the blade root) which provides air substantially along the outer surface of a centerbody 42 (centerbody 42 is to be discussed in greater detail hereinafter). In order to provide the desired effects on the air stream entering mixing duct 40, inner radial portion 72 of vane 32 preferably has a leading edge 74 oriented at an angle $\alpha i_{inner}$ approximately 0–30° with respect to an axis 76 oriented radially thereto and a trailing edge 78 oriented at an angle $\beta i_{inner}$ approximately −10° to +10° with respect to such axis 76 (see FIGS. 5A and 5C). Correspondingly, outer radial portion 70 of vane 32 preferably has a leading edge 80 oriented at an angle $\alpha i_{outer}$ approximately +10° to −10° with respect to axis 76 and a trailing edge 82 oriented at an angle $\beta i_{outer}$ approximately 50–60° with respect to axis 76 (see FIGS. 5B and 5C). It will be appreciated that the respective leading and trailing edge angles for inner and outer portions 72 and 70 of inner annular swirler vanes 32 are best seen schematically in the graph of FIG. 5C.

Figure 2:
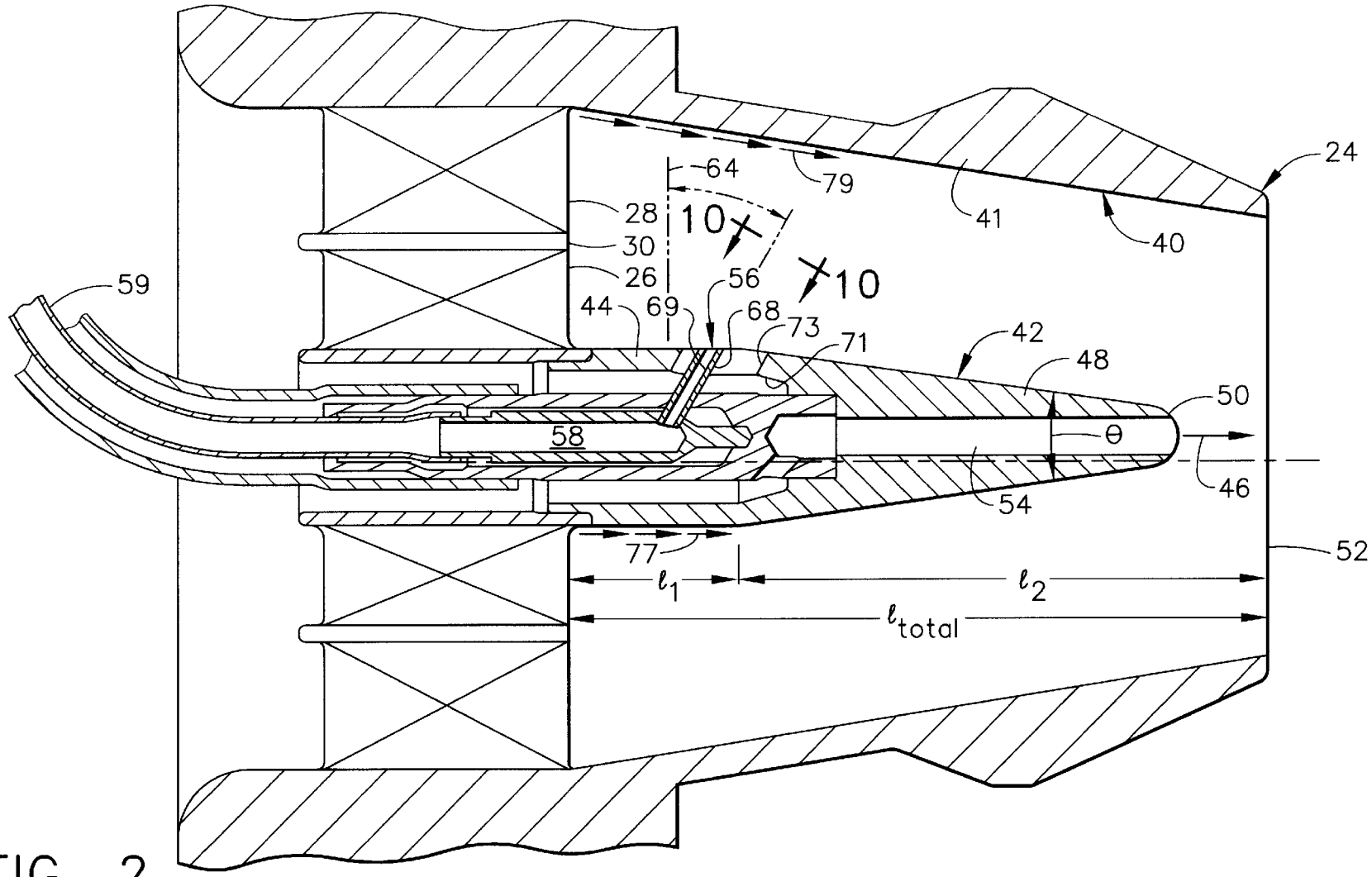
FIG. 2 is an enlarged, partial cross-sectional view of the air/fuel mixer and combustor dome portion depicted in FIG. 1.

It will be understood that inner radial portion 72 of vanes 32 is configured to provide a boundary layer 77 (see FIG. 2) of air along centerbody 42 in order to prevent flow separation from residing in such location. Since the flow area required for boundary layer 77 is minimal compared to the swirl area of mixing duct 40, inner radial portion 72 preferably will have a radial height $hi_{inner}$ only approximately 5–20% of the total radial height $hi_{total}$ of vane 32 (see FIG. 5C).

Figure 5A:
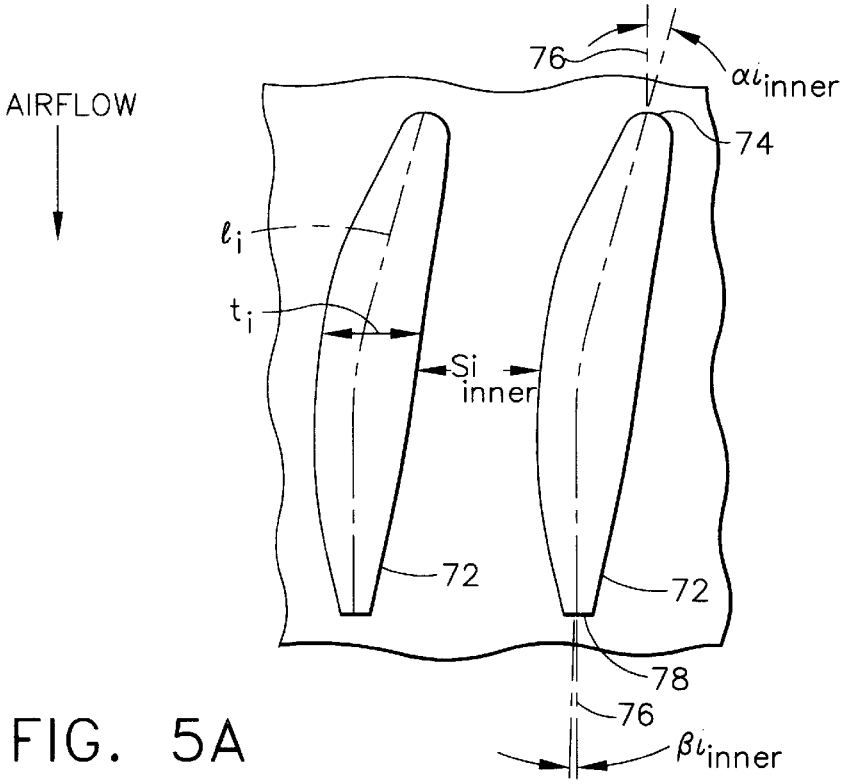
FIG. 5A is a diagrammatic side view of the root portions for a pair of adjacent swirler vanes from the inner annular swirler of FIG. 3.
Figure 5B:
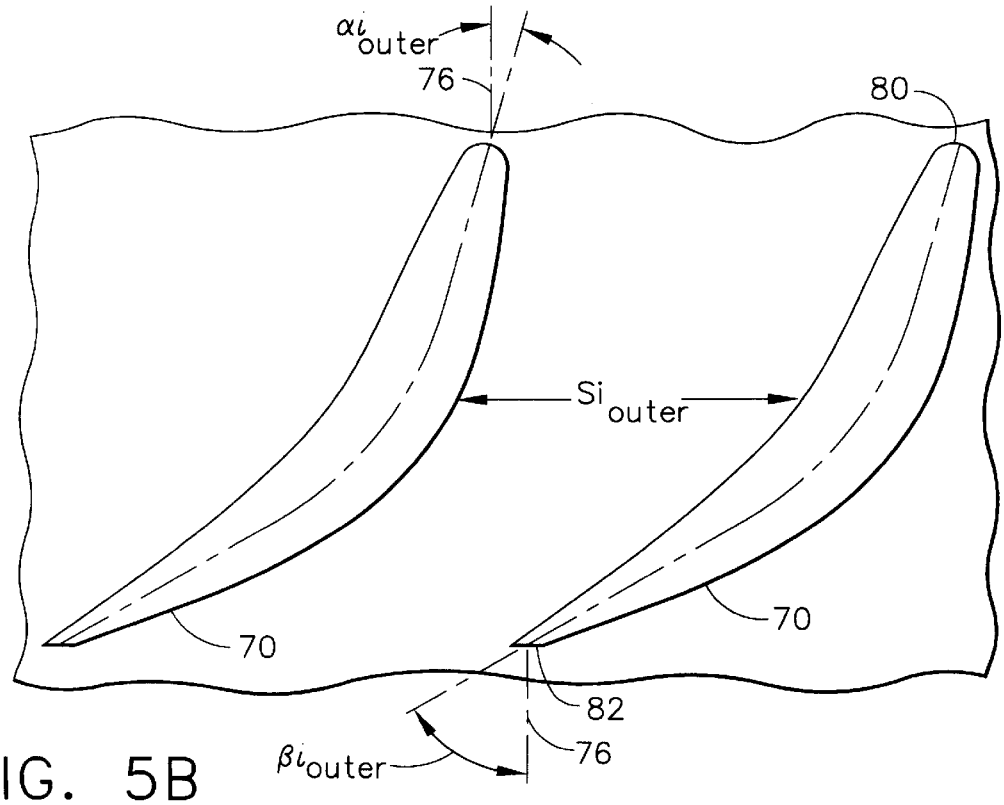
FIG. 5B is a diagrammatic side view of the tip portions for a pair of adjacent swirler vanes from the inner annular swirler of FIG. 3.
Figure 5C:
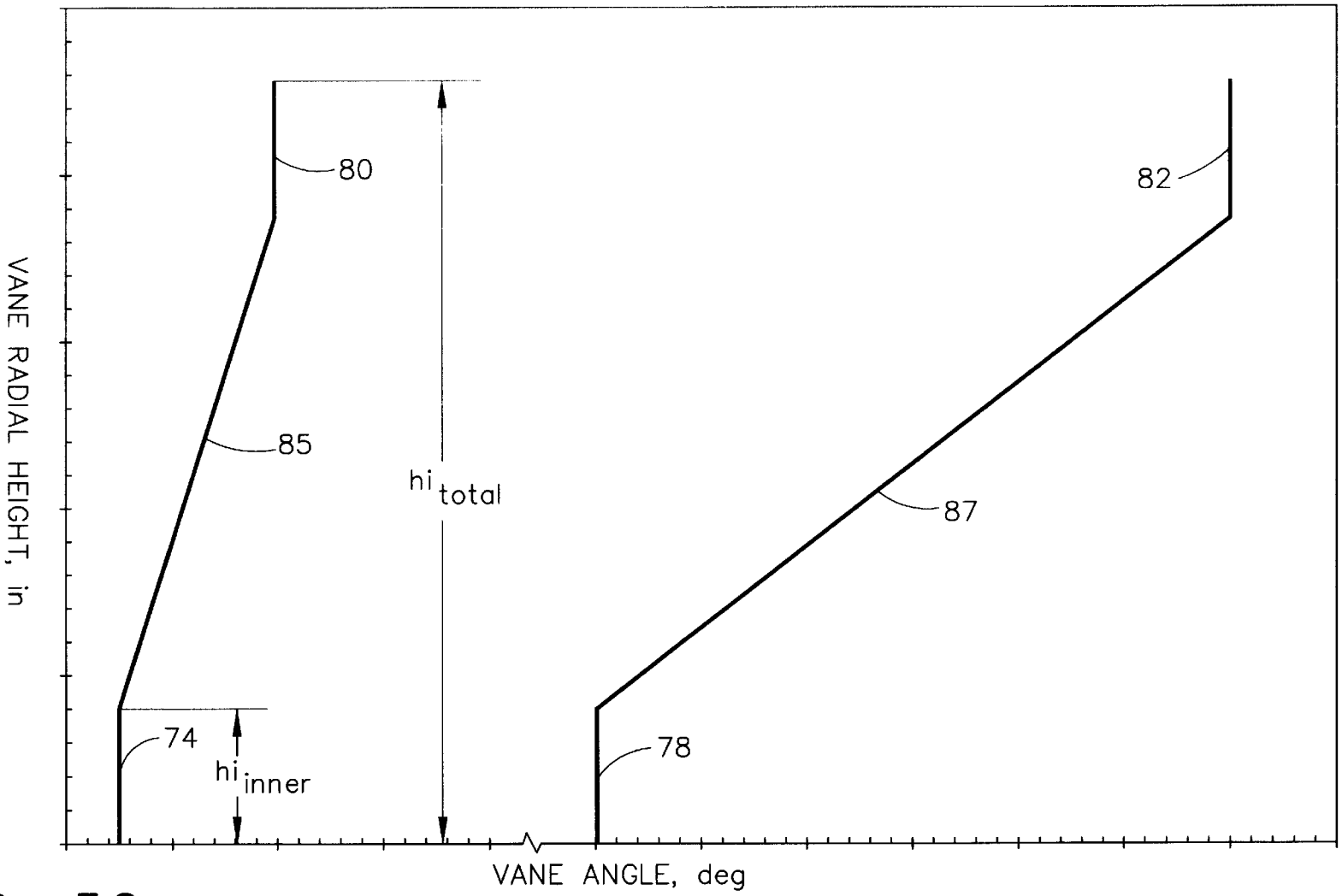
FIG. 5C is a graph schematically depicting the change in angles at the leading and trailing edges between the inner and outer radial portions of the inner annular swirler vanes shown in FIGS. 3–5B.
Figure 7:
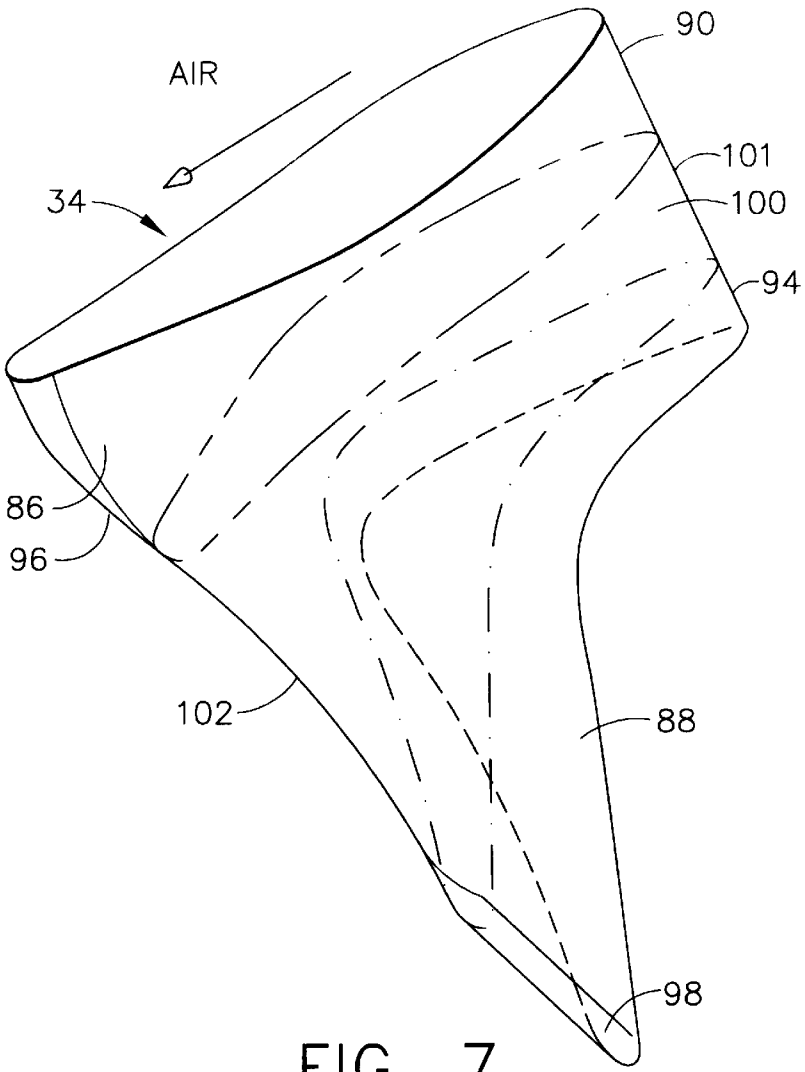
FIG. 7 is a perspective view of an outer swirler vane depicted in FIG. 6, wherein a plurality of separate cross-sections at different radial heights is shown.

Further, it is desired that vanes 32 have a solidity in the range of 2.0–4.0 at inner radial portion 72 and in the range of 1.5–3.0 at outer radial portion 70. Solidity is defined as chord length l of vane 32 divided by circumferential spacing s between adjacent vanes. FIG. 5A depicts these parameters for inner radial portion 72 and FIG. 5B depicts such parameters for outer radial portion 70. It is also desired that vanes 32 have a thickness $t_i$, as compared to chord length $l_i$, so that wide angles of attack may be tolerated without flow separation from leading edges 74 and 80 thereof. In this regard, it has been found that a thickness-to-length ratio of approximately 0.18 or greater will be sufficient.

Although inner annular swirler vanes 32 preferably have a symmetrical airfoil shape when viewed in cross-section (see FIG. 4), it will be appreciated that such vanes 32 further include a transitional portion 84 located between outer radial portion 70 and inner radial portion 72. Transitional portion 84 has a leading edge 85 and a trailing edge 87 which functions to provide a gradual change between leading edges 74 and 80, as well as trailing edges 78 and 82, of inner and outer radial portions 72 and 70, respectively (see FIG. 5C). Transitional portion 84 also involves a twisting design (approximately 80° to 100° clockwise when forward looking aft) with respect to a longitudinal axis 46 of mixer 24 for effecting the gradual axial change between the leading edges and trailing edges of outer radial portion 70 and inner radial portion 72.

Figure 8A:
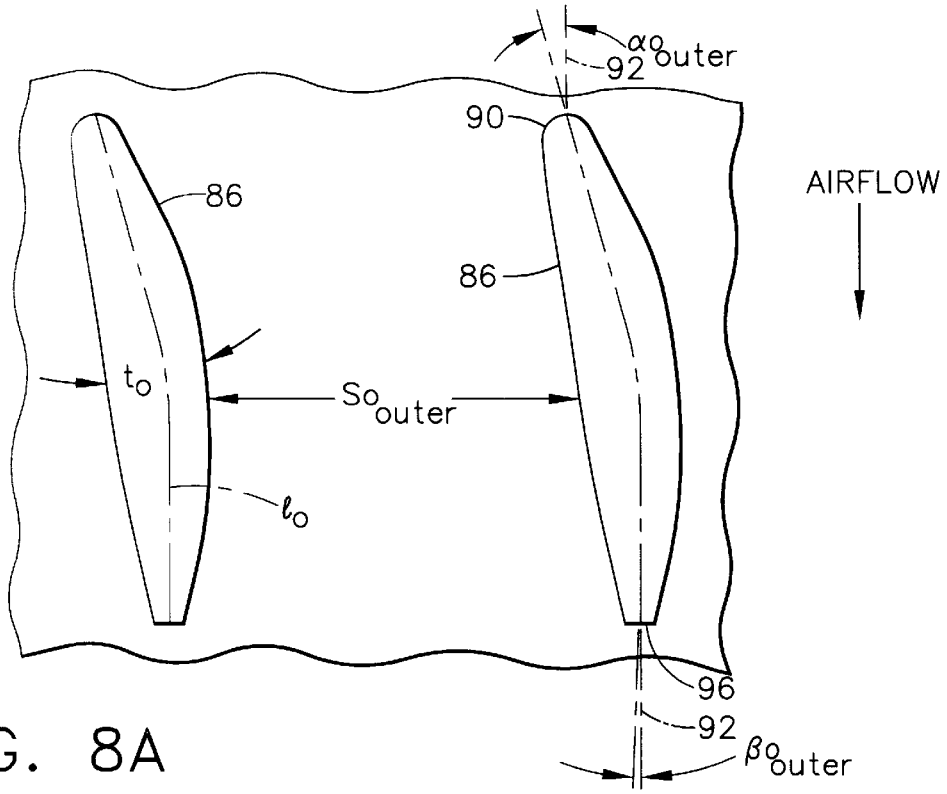
FIG. 8A is a diagrammatic side view of the tip portions for a pair of adjacent swirler vanes from the outer annular swirler of FIG. 6.
Figure 8B:
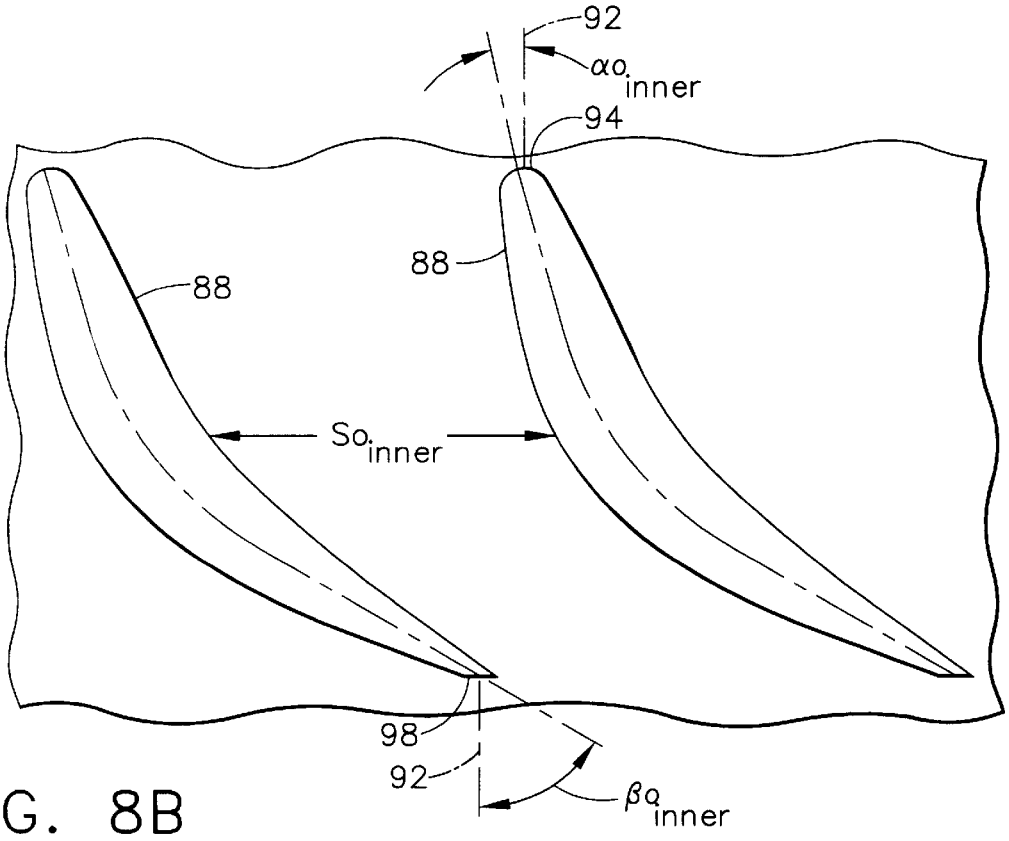
FIG. 8B is a diagrammatic side view of the root portions for a pair of adjacent swirler vanes from the outer annular swirler of FIG. 6.

While typically not employed when fuel is supplied through passages therein, outer annular swirler vanes 34 also may be configured (in mirror image) like inner annular swirler vanes 32 described above and depicted in FIGS. 6–8C in order to provide a boundary layer 79 (see FIG. 2) of air along wall 41 of mixing duct 40. In such case, outer annular swirler vanes 34 will have an outer radial portion 86 to provide boundary layer 79 substantially along mixing duct wall 41 and an inner radial portion 88 for providing swirl to the air stream flowing therethrough (opposite the swirl direction provided by inner annular swirler vanes 32). Outer radial portion 86 will preferably have a leading edge 90 with an angle $\alpha o_{outer}$ of approximately −10° to +10° with respect to an axis 92 (see FIGS. 8A and 8C) while inner radial portion 86 will preferably have a leading edge 94 with an angle $\alpha o_{inner}$ approximately 0–30° with respect to axis 92 (see FIGS. 8B and 8C). Although mixing duct 40 will typically be frusto-conical in shape, and mixing duct wall 41 likely will be oriented at an angle of approximately 10° to 20° to longitudinal axis 46 and thus to outer annular swirler 28 (as opposed to forward section 44 of centerbody 42 being substantially aligned or parallel to longitudinal axis 46 and inner annular swirler 26), trailing edge 96 for outer radial portion 86 will still preferably have an angle $\beta o_{outer}$ approximately −10° to 10° with respect to axis 92 (see FIGS. 8A and 8C) while angle $\beta o_{inner}$ for trailing edge 98 of inner radial portion 88 will be approximately −50° to −60° (see FIGS. 8B and 8C). It will be noted that the respective leading and trailing edge angles for inner and outer portions 88 and 86 of outer annular swirler vanes 34 are best seen schematically in the graph of FIG. 8C. The radial height $ho_{outer}$ of outer radial portion 86 will preferably be approximately 5–20% of the total radial height $ho_{total}$ of vane 34 since only a relatively small amount of flow area is required to provide boundary layer 79 along mixing duct wall 41 compared to the swirl area within mixing duct 40 (see FIG. 8C).

As with inner annular swirler vanes 32 described above, it is desired that outer annular swirler vanes 34 have a solidity in the range of 1.5–3.0 at outer radial portion 86 and 2.0–4.0 at inner radial portion 88. Further, vanes 34 will preferably have a thickness $t_o$, when compared to the chord length $l_0$, that will tolerate a wide angle of attack without flow separation from leading edges 90 and 94 thereof (approximately 0.18 or greater).

Figure 8C:
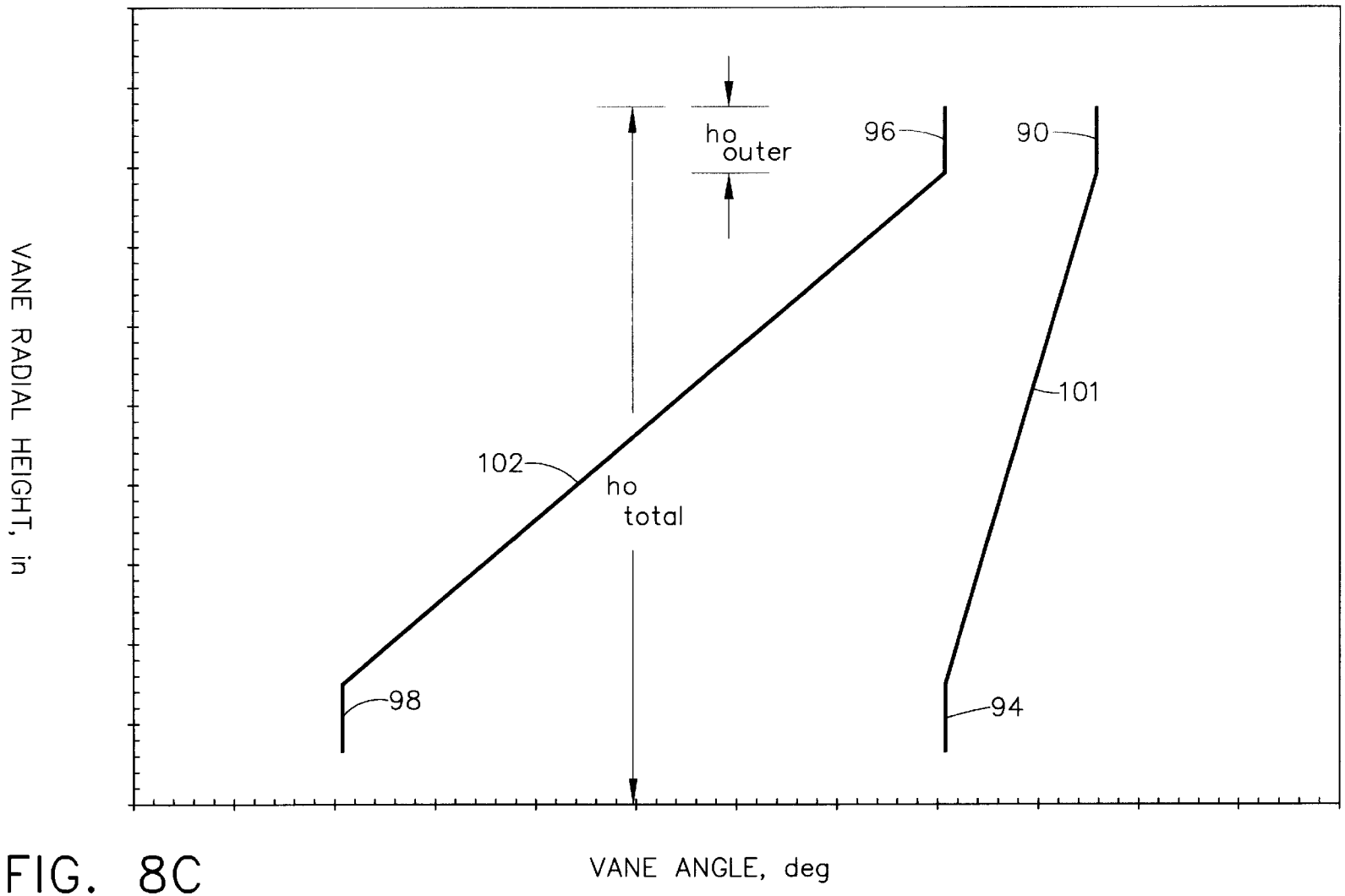
FIG. 8C is a graph schematically depicting the change in angles at the leading and trailing edges between the inner and outer radial portions of the outer annular swirler vanes shown in FIGS. 6–8B.

Outer annular swirler vanes 34 will also preferably have a symmetrical airfoil shape when viewed in cross-section (see FIG. 7), but will include a transitional portion 100 with a leading edge 101 and a trailing edge 102 located between outer and inner radial portions 86 and 88, respectively, to provide a gradual change between leading edges 90 and 94 and trailing edges 96 and 98 thereof (see FIG. 8C). Transitional portion 100 also includes a twisting design with respect to longitudinal axis 46 (approximately 80° to 100° counter-clockwise when viewed forward looking aft) for effecting the gradual change between the leading and trailing edges of outer radial portion 86 and inner radial portion 88.

A shroud 36 is provided which surrounds mixer 24 at the upstream end thereof with a fuel manifold 38 contained therein. Downstream of inner and outer annular swirlers 26 and 28 is an annular mixing duct 40 as defined by an annular wall 41. In at least one embodiment, fuel manifold 38 may be in flow communication with vanes 34 of outer swirler 28 where it is metered by an appropriate fuel supply and control mechanism depicted schematically by box 25 in FIG. 1. Vanes 34 of outer swirler 28 are then preferably of a hollow design, as shown and described in FIGS. 4*a* and 4*b* of U.S. Pat. No. 5,251,447, with internal cavities in flow communication with fuel manifold 38 and fuel passages in flow communication with the internal cavities. It will be seen in FIG. 1 that a purge air supply 27 is also preferably associated with manifold 38 so that air may be supplied to a purge manifold (not shown) and the internal cavities and vane passages when fuel is not injected therethrough. This purge air prevents hot air in combustion chamber 14 from recirculating into such fuel passages.

A centerbody 42 is provided in mixer 24 which, contrary to prior designs, preferably has a forward section 44 which is substantially parallel to longitudinal axis 46 through mixer 24 and an aft section 48 which converges substantially uniformly to a downstream tip 50 of centerbody 42. It will be noted that forward centerbody section 44 extends from an upstream end adjacent inner and outer annular swirlers 26 and 28 downstream to a point so that it has an axial length $l_1$. Centerbody aft section 48 then extends from the downstream end of centerbody forward section 44 to tip 50 so as to have an axial length $\mathbf{l}_2$. It will be appreciated that axial length $\mathbf{l}_2$ of centerbody aft section 48 will generally be greater than axial length $l_1$, of centerbody forward section 44 since an angle of convergence θ for centerbody aft section 48 is preferably less than approximately 20°. Otherwise, given the total axial length $l_{total}$ of mixing duct 40, the separation of flow between centerbody forward and aft sections 44 and 48, respectively, has a tendency to increase.

Centerbody 42 is preferably cast within mixer 24 and is sized so as to terminate immediately prior to a downstream end 52 of mixing duct 40 in order to address a distress problem at centerbody tip 50, which occurs at high pressures due to flame stabilization at this location. Centerbody 42 preferably includes a passage 54 through centerbody tip 50 in order to admit air of a relatively high axial velocity into combustion chamber 14 adjacent centerbody tip 50. This design decreases the local fuel/air ratio to help push the flame downstream of centerbody tip 50.

Centerbody 42 further includes a plurality of orifices 56 positioned preferably immediately upstream of centerbody aft section 48 from which fuel also can be injected into mixing duct 40. Centerbody fuel orifices 56 are spaced circumferentially about centerbody forward section 44 and while the number and size of such orifices 56 is dependent on the amount of fuel supplied thereto, the pressure of the fuel, and the number and particular design of swirlers 26 and 28, it has been found that 4 to 12 orifices work adequately. Fuel is supplied to centerbody orifices 56 by means of a fuel passage 58 within an upstream portion of centerbody 42. Fuel passage 58 is in turn in flow communication with a fuel supply and control mechanism 60, such as by means of a fuel nozzle entering the upstream portion of centerbody 42 or a fuel line 59 in flow communication with a separate fuel manifold in shroud 36 (shown in FIG. 2). It will be understood that if gaseous and liquid fuel are to be injected within mixer 24, the gas fuel will preferably be injected through passages in outer swirler 28 and the liquid fuel will be injected through centerbody fuel orifices 56. Further, fuel passage 58 is also associated with a purge air supply 62 so that air may be used to purge fuel from fuel passage 58 and orifices 56 when fuel is not injected into mixing duct 40 therethrough. Accordingly, it will be understood that the change of fuel types may be accomplished "on the fly" by ramping the amount of fuel injected through the outer swirler passages or centerbody orifices 56 up while correspondingly ramping down the fuel injected by the other.

Figure 12:
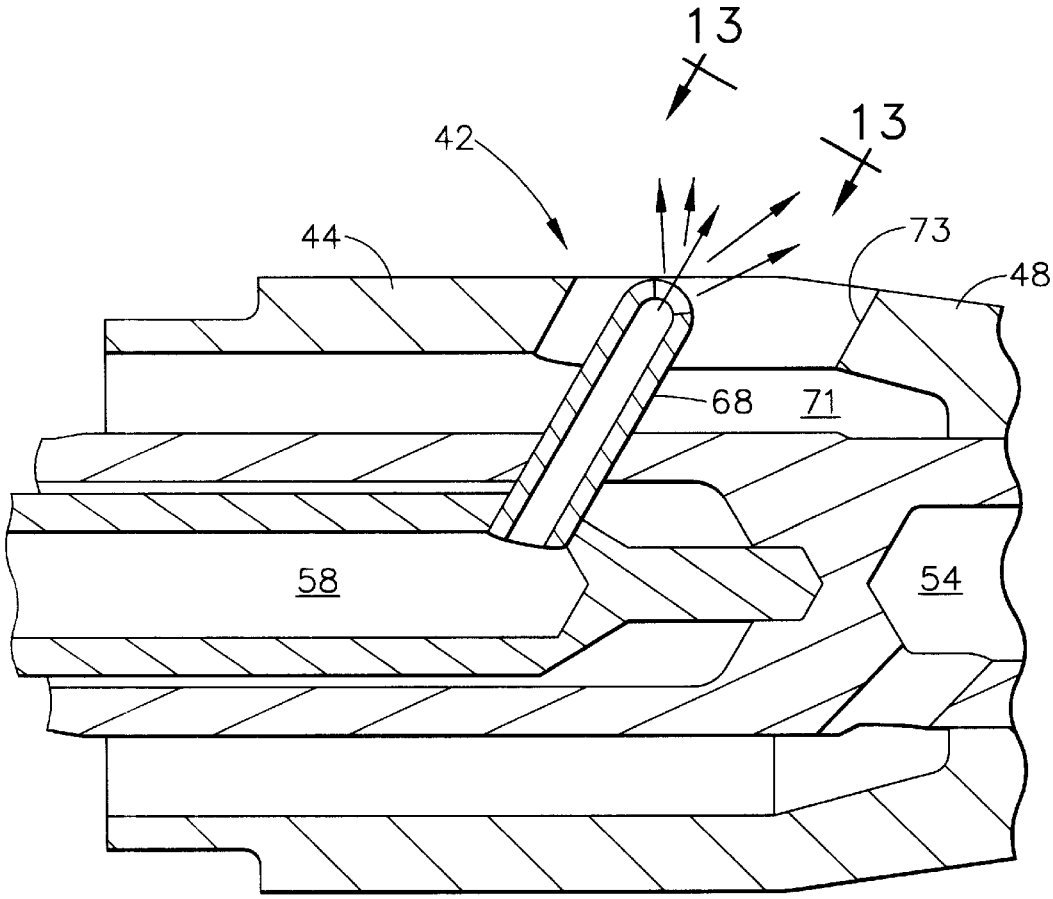
FIG. 12 is a partial cross-sectional view of the air/fuel mixer depicted in FIGS. 1 and 2 in which the centerbody has an alternative fuel post design.
Figure 13:
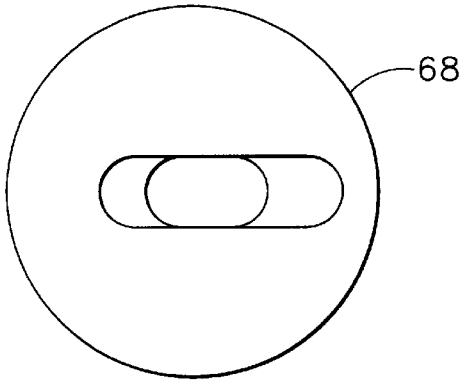
FIG. 13 is a partial radial view of the air/fuel mixer taken along line 13—13 in FIG. 12.

More specifically, fuel orifices 56 are oriented with respect to mixing duct 40 (preferably 15–60° with respect to a radial axis 64) so as to impart an velocity component in the axial direction (i.e., along longitudinal axis 46), thereby reducing the residence time for such fuel within mixing duct 40. This is accomplished via fuel passage 58 in centerbody 42 which is in flow communication with fuel supply 60 and preferably a plurality of circumferentially spaced posts 68 with a fuel hole 69 in flow communication with fuel passage 58. It will be appreciated that posts 68 may be configured to inject a fuel jet or a fan spray of fuel (see FIGS. 12 and 13) into mixing duct 40.

Figure 10:
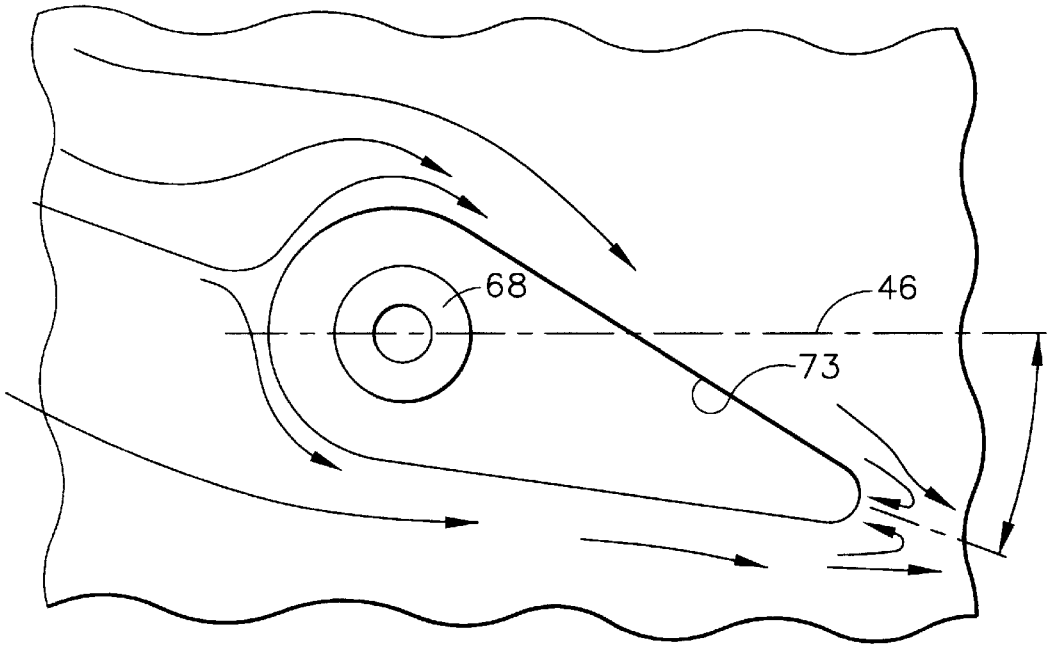
FIG. 10 is a partial radial view of the air/fuel mixer taken along line 10—10 of FIG. 2 where an aerodynamic air-assist slot is shown.
Figure 11:
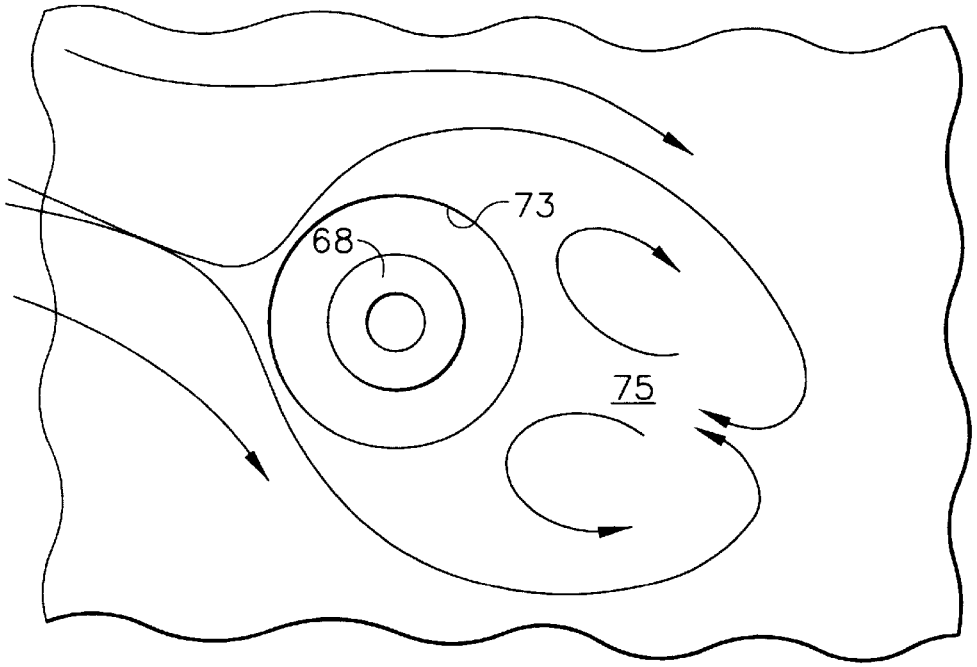
FIG. 11 is a partial radial view of an alternative air-assist slot configuration as would be seen along line 10—10 of FIG. 2.

In order to assist in atomization and break up of fuel injected into mixing duct 40 through posts 68, an air cavity 71 is provided in centerbody 42. Air cavity 71 is in flow communication with purge air supply 62 and provides air to slots 73 located concentrically about each post 68 in addition to air passage 54. While air slots 73 may be circular in shape as shown in FIG. 11, it is preferred that they have an aerodynamic shape as seen in FIG. 10. This is because a small recirculation zone 75 (see FIG. 11) has a tendency to form downstream of slots 73, which is due to the shape of such slots. By changing the shape of slots 73 to be aerodynamic, the flow separation along centerbody aft section 48 (and thus the recirculation zone formed thereabout) can be minimized. In fact, it will be appreciated that slots 73 having an aerodynamic shape may be utilized regardless of the orientation of fuel posts 68 (may be substantially radial to axis 46) and the design of centerbody 42 (may be substantially converging throughout). Another way to positively affect this circumstance is to align slots 73 with the residual swirl component along centerbody 42 by angling slots 73 approximately 10–20° with respect to longitudinal axis 46.

In operation, compressed air from a compressor (not shown) is injected into the upstream end of mixer 24 where it passes through inner and outer swirlers 26 and 28 and enters mixing duct 40. Fuel is injected into an air flow stream exiting swirlers 26 and 28 (which includes intense shear layers in the middle area of mixing duct 40 and boundary layers 77 and 79 along centerbody 42 and mixing duct wall 41, respectively) from passages within vanes 34 and /or fuel orifices 56 in centerbody 42. At the downstream end of mixing duct 40, the premixed fuel/air flow is supplied into a mixing region of combustor chamber 14 which is bounded by inner and outer liners 18 and 16. The premixed fuel/air flow is then mixed with recirculating hot burnt gases in combustion chamber 14. In light of the improvements by the inventive mixer described herein, however, where flow separations are minimized at high power operating conditions, the concerns of eliminating flashback and auto-ignition within mixing duct 40 are met.

Having shown and described the preferred embodiment of the present invention, further adaptations of the air fuel mixer can be accomplished by appropriate modifications by one of ordinary skill in the art without departing from the scope of the invention. Accordingly, the manner in which fuel is provided to mixing duct 40 is not imperative in order to obtain the benefits of the inner and outer swirler vanes described herein.

What is claimed is:

1. An apparatus for premixing fuel and air prior to combustion in a gas turbine engine, comprising:

(a) a linear mixing duct having a circular cross-section defined by a wall;

(b) a centerbody located along a central axis of said mixing duct and extending substantially the full length of said mixing duct, said centerbody having a plurality of orifices therein to inject fuel into said mixing duct;

(c) a fuel supply in flow communication with said centerbody orifices;

(d) an outer annular swirler located adjacent an upstream end of said mixing duct and including a plurality of circumferentially spaced vanes oriented so as to swirl air flowing therethrough in a first direction;

(e) an inner annular swirler located adjacent said mixing duct upstream end and including a plurality of circumferentially spaced vanes, said inner annular swirler vanes further comprising:

(1) an outer radial portion having a leading edge and a trailing edge oriented so as to swirl air flowing therethrough in a second direction opposite said first swirl direction by said outer annular swirler vanes; and (2) an inner radial portion having a leading edge and a trailing edge, said inner radial portion trailing edge being oriented differently from said outer radial portion trailing edge so as to provide a boundary layer of air extending from said inner radial portion trailing edge substantially along said centerbody; and (f) a hub separating said inner and outer annular swirlers to permit independent rotation of an air stream therethrough;

wherein high pressure air from a compressor is injected into said mixing duct through said inner and outer annular swirlers and fuel is injected into said mixing duct so that the high pressure air and the fuel is uniformly mixed therein, whereby minimal formation of pollutants is produced when the fuel/air mixture is exhausted out the downstream end of said mixing duct into a combustor and ignited.

2. The apparatus of claim 1, wherein said inner radial portion of said inner annular swirler vanes has a leading edge angled approximately 0° to −30° with respect to a radial axis therethrough.

3. The apparatus of claim 1, wherein said inner radial portion of said inner annular swirler vanes has a trailing edge angled approximately +10° to −10° with respect to a radial axis therethrough.

4. The apparatus of claim 1, wherein said outer radial portion of said inner annular swirler vanes has a leading edge angled approximately +10° to −10° with respect to a radial axis therethrough.

5. The apparatus of claim 1, wherein said outer radial portion of said inner annular swirler vanes has a trailing edge angled approximately 50° to 60° with respect to a radial axis therethrough.

6. The apparatus of claim 1, wherein said inner annular swirler vanes have trailing and leading edges which are angled with respect to a radial axis therethrough so as to provide vane solidity at said outer radial portion of said inner annular swirler vanes in a range of 2.0–4.0.

7. The apparatus of claim 1, wherein said inner annular swirler vanes have a symmetrical airfoil shape when viewed in cross-section.

8. The apparatus of claim 7, wherein said inner annular swirler vanes have a thickness-to-length ratio of approximately 0.18 or greater to tolerate wide angles of attack without flow separation from said leading edges of said inner annular swirler varies.

9. The apparatus of claim 1, wherein said inner radial portion of said inner annular swirler seine has a radial height approximately 5–20% of the total radial height for said inner annular swirler vanes.

10. The apparatus of claim 1, said inner annular swirler vanes further comprising a transitional portion located between said outer and inner radial portions for effecting a gradual change between said leading and trailing edges for said outer and inner radial portions.

11. The apparatus of claim 10, wherein said transitional portion of said inner annular swirler vanes twist approximately 80° to 100° with respect to said central axis for effecting a gradual axial change between said outer and inner radial portions.

12. The apparatus of claim 1, said outer annular swirler vanes further comprising:

(a) an outer radial portion having a leading edge and a trailing edge oriented so as to provide a boundary layer of air substantially along said mixing duct wall; and (b) an inner radial portion having a leading edge and a trailing edge oriented so as to swirl air flowing therethrough in said first swirl direction.

13. The apparatus of claim 1, wherein said orifices inject fuel into said mixing duct at an angle of approximately 15° to 60° from a radial axis through said centerbody so as to impart an axial velocity component thereto.

14. The apparatus of claim 1, said centerbody further comprising:

(a) a forward section extending through and downstream of said inner annular swirler which is substantially parallel to said central axis; and (b) an aft section downstream of said forward section which converges toward said central axis.

15. The apparatus of claim 14, wherein said aft centerbody section has a greater axial length than said forward centerbody section.

16. The apparatus of claim 14, wherein orifices are located within said forward centerbody section downstream of said inner annular swirler and immediately upstream of said centerbody aft section, said orifices being in flow communication with said fuel supply.

17. The apparatus of claim 16, wherein said orifices inject fuel into said mixing duct at an angle of approximately 15° to 60° from a radial axis through said centerbody so as to impart an axial velocity component thereto.

18. The apparatus of claim 1, said centerbody further comprising:

(a) a first cavity therein in flow communication with said fuel supply; and (b) a plurality of circumferentially spaced posts angled with respect to a radial axis through said centerbody, each of said posts including a fuel hole therethrough in flow communication with said first cavity;

wherein said fuel is injected into said mixing duct through said posts with an axial velocity component.

19. The apparatus of claim 18, wherein said posts are angled within a range of approximately 15° to 60° with respect to said radial axis.

20. The apparatus of claim 18, wherein the fuel holes through said posts are configured to provide a fan spray into said mixing duct.

21. The apparatus of claim 18, said centerbody further comprising:

(a) a second cavity therein in flow communication with an air supply; and (b) a slot located concentrically about each said post in flow communication with said second cavity;

wherein air flows through said slots to assist atomization and break up of fuel injected into said mixing duct through said posts.

22. The apparatus of claim 21, wherein said slots are aligned with a residual swirl component along said centerbody.

23. The apparatus of claim 21, wherein said slots are aerodynamically shaped so as to minimize any flow separated region forming along said centerbody.

24. The apparatus of claim 21, wherein said slots are angled approximately 10° to 20° with respect to said central axis.

25. The apparatus of claim 21, wherein said slots are oriented substantially parallel to said posts with respect to said radial axis.

26. An apparatus for premixing fuel and air prior to combustion in a gas turbine engine, comprising:

(a) a linear mixing duct having a circular cross-section defined by a wall;

(b) a fuel supply in flow communication with said mixing duct;

(c) an inner annular swirler located adjacent an upstream end of said mixing duct and including a plurality of circumferentially spaced vanes oriented so as to swirl air flowing therethrough in a first direction;

(d) an outer annular swirler located adjacent said mixing duct upstream end and including a plurality of circumferentially spaced vanes, said outer annular swirler vanes further comprising:

(1) an outer radial portion having a leading edge and a trailing edge, said outer radial portion trailing edge being oriented so as to provide a boundary layer of air extending from said trailing edge substantially along said mixing duct wall; and (2) an inner radial portion having a leading edge and a trailing edge, said inner radial portion trailing edge being oriented differently from said outer radial portion trailing edge so as to swirl air flowing therethrough in a second direction opposite said first swirl direction by said inner annular swirler vanes; and (e) a hub separating said inner and outer annular swirlers to permit independent rotation of an air stream therethrough;

wherein high pressure air form a compressor is injected into said mixing duct through said inner and outer annular swirlers and fuel in injected into said mixing duct so that the high pressure air and the fuel is uniformly mixed therein, whereby minimal formation of pollutants is produced when the fuel/air mixture is exhausted out the downstream end of said mixing duct into a combustor and ignited.

27. The apparatus of claim 26, wherein said outer radial portion of said outer annular swirler vanes has a leading edge angled approximately 0° to −30° with respect to a radial axis therethrough.

28. The apparatus of claim 26, wherein said outer radial portion of said outer annular swirler vanes has a trailing edge angled approximately +10° to −10° with respect to a radial axis therethrough.

29. The apparatus of claim 26, wherein said inner radial portion of said outer annular swirler vanes has a leading edge angled approximately +10° to −10° with respect to a radial axis therethrough.

30. The apparatus of claim 26, wherein said inner radial portion of said outer annular swirler vanes has a trailing edge angled approximately 50° to 60° with respect to a radial axis therethrough.

31. The apparatus of claim 26, wherein said outer annular swirler vanes have trailing and leading edges which are angled with respect to a radial axis therethrough so as to provide a vane solidity at said inner radial portion of said outer annular swirler vanes in a range of 2.0–4.0.

32. The apparatus of claim 26, wherein said outer annular swirler vanes have a symmetrical airfoil shape when viewed in cross-section.

33. The apparatus of claim 32, wherein said inner annular swirler vanes have a thickness-to-length ratio of approximately 0.18 or greater to tolerate wide angles of attack without flow separation from said leading edges of said outer annular swirler vanes.

34. The apparatus of claim 26, wherein said outer radial portion of said outer annular swirler vane has a radial height approximately 5–20% of the total radial height for said outer annular swirler vanes.

35. The apparatus of claim 26, said outer annular swirler vanes further comprising a transitional portion located between said outer and inner radial portions for effecting a gradual change between said leading and trailing edges for said outer and inner radial portions.

36. The apparatus of claim 35, wherein said transitional portion of said outer annular swirler vanes twist approximately 80° to 100° with respect to said central axis for effecting a gradual axial change between said outer and inner radial portions.

37. An apparatus for premixing fuel and air prior to combustion in a gas turbine engine, comprising:

(a) a linear mixing duct having a circular cross-section defined by a wall;

(b) a set of inner and outer annular counter-rotating swirlers adjacent an upstream end of said mixing duct;

(c) a hub separating said inner and outer annular swirlers to allow independent rotation of an air stream through said swirlers;

(d) a centerbody located along a central axis of said mixing duct and extending substantially the full length of said mixing duct, said centerbody further comprising:

(1) a plurality of fuel posts therein located downstream of said inner and outer annular swirlers to inject fuel into said mixing duct;

(2) an air cavity in flow communication with an air supply; and (3) an aerodynamically-shaped air slot located concentrically about each said fuel post in flow communication with said air cavity, wherein air flows through said aerodynamically-shaped slots to assist atomization and break up of fuel injected into said mixing duct through said posts while minimizing any flow separated region forming along said centerbody; and (e) a fuel supply in flow communication with said fuel posts; wherein high pressure air from a compressor is injected into said mixing duct through said inner and outer annular swirlers and fuel is injected into said mixing duct so that the high pressure air and the fuel is uniformly mixed therein, whereby minimal formation of pollutants is produced when the fuel/air mixture is exhausted out the downstream end of said mixing duct into a combustor and ignited.

38. The apparatus of claim 37, wherein said fuel posts and aerodynamically-shaped air slots are oriented substantially radially to said central axis.

39. The apparatus of claim 37, said centerbody further comprising:

(a) a forward section extending through and downstream of said inner annular swirler which is substantially parallel to said central axis; and (b) an aft section downstream of said forward section which converges toward said central axis.

* * * * *